US008314729B2

(12) United States Patent
Maier

(10) Patent No.: US 8,314,729 B2
(45) Date of Patent: Nov. 20, 2012

(54) REMOTE CONTROL

(75) Inventor: Ferdinand Maier, Obertrum am See (AT)

(73) Assignee: FM Marketing GmbH, Obertrum am See (AT)

( * ) Notice: Subject to any disclaimer, the term of this patent is extended or adjusted under 35 U.S.C. 154(b) by 441 days.

(21) Appl. No.: 12/697,682

(22) Filed: Feb. 1, 2010

(65) Prior Publication Data

US 2010/0127914 A1 May 27, 2010

Related U.S. Application Data

(63) Continuation of application No. PCT/EP2008/006249, filed on Jul. 29, 2008.

(30) Foreign Application Priority Data

Aug. 1, 2007 (EP) ..... 07015080

(51) Int. Cl.
*G08C 19/12* (2006.01)

(52) U.S. Cl. ..... 341/176; 345/158

(58) Field of Classification Search ..... 345/158, 345/163; 340/12.55, 13.31; 341/176
See application file for complete search history.

(56) References Cited

U.S. PATENT DOCUMENTS

| | | | | |
|---|---|---|---|---|
| 5,554,980 | A * | 9/1996 | Hashimoto et al. | 345/158 |
| 7,605,689 | B2 * | 10/2009 | Hein et al. | 340/426.15 |
| 7,786,623 | B2 * | 8/2010 | Farmer et al. | 307/117 |
| 7,889,175 | B2 * | 2/2011 | Kryze et al. | 345/156 |
| 8,193,759 | B2 * | 6/2012 | Lee | 320/101 |
| 2003/0206128 | A1 | 11/2003 | Moore | |
| 2009/0113961 | A1 | 5/2009 | Muller | |

FOREIGN PATENT DOCUMENTS

| | | |
|---|---|---|
| DE | 19653840 A1 | 6/1998 |
| GB | 2369046 | 5/2002 |
| KR | 20040077349 A | 9/2004 |

OTHER PUBLICATIONS

Abstract of DE19653840; Jun. 25, 1998.
Abstract of KR20040077349; Sep. 4, 2004.
International Search Report, PCT/EP2008/006249, Dec. 11, 2008, 3 pages.
Written Opinion, PCT/EP2008/006249, Dec. 11, 2008, 6 pages.

* cited by examiner

*Primary Examiner* — Brian Young
(74) *Attorney, Agent, or Firm* — Senniger Powers LLP

(57) ABSTRACT

A remote control having a touch-sensitive key pad, an energy store, a transmitter, two plates joined together on which these are arranged, and a position sensor which provides an on/off function depending on its position or orientation.

26 Claims, 1 Drawing Sheet

REMOTE CONTROL

REFERENCE TO RELATED APPLICATION

This application claims priority to European application EP 07015080.0 filed Aug. 1, 2007, and is a continuation of PCT/EP2008/006249 which was filed Jul. 29, 2008, the entire disclosures of which are incorporated by reference.

FIELD OF THE INVENTION

The invention relates to a remote control of the type having electronic components, a touch-sensitive key pad, an energy store, and a transmitter.

BACKGROUND OF THE INVENTION

Such a remote control is known from DE 196 53 840 A1. There, a manual transmitter for a remotely operated central locking system in motor vehicles is shown, having a housing, a transmitting means, an electronic control circuit for controlling the transmitting means, and a solar cell, which supplies electric energy to the control circuit.

GB 2 396 046 A shows an alarm key trailer with a housing of transparent plastic, inside which is arranged an incandescent bulb, which begins to shine in event of an alarm. Moreover, two pushbutton switches are arranged on the housing for activating and deactivating the alarm.

US 2003/0206128 A1 shows a universal remote control with a transparent acrylic housing, inside which there is again placed an incandescent bulb. Using a locator, the incandescent bulb can be made to light up and an acoustic transmitter can be activated.

DE 20 2005 015 165 U1 shows a remotely controlled locking device for a vehicle, in which a keypad and a touch screen display are formed.

Remote controls for the control of electronic devices, such as television sets, radios, video recorders, satellite receivers, DVD players, but also other household appliances such as lighting systems, roll-down shutters, garage doors and the like, are widespread today. They usually have a housing with a battery compartment, a conductor track board with electronic components, a keypad as well as a transmitting unit, such as an infrared transmitting diode. One of the keys is customarily used for turning the remote control on and off. The other keys are assigned one or more functions, such that when the key is pressed an encoded infrared signal is sent out to the device being controlled.

Instead of a keypad with individual mechanically actuated keys, it has also already been proposed to use a touch-sensitive key pad, which is generally known today as a touch pad (see DE 199 08 406 A1, DE 100 13 444 A1) or also a so-called touch screen, i.e., a display device which is at the same time sensitive to touch (see U.S. Pat. Nos. 5,237,327, 5,353,016).

Touch pads and touch screens are generally known and are specified, for example, by WO 92/04724 or DE 20 2007 001 624 U1. They work by various principles, including capacitive, resistive, optical, or with sound waves (surface acoustic waves). These devices, subsumed under "touch-sensitive key pads", generate an electrical signal which is generally coordinated unambiguously with one or more places on its surface that are touched by an object or by a finger.

It is thus possible to replace the functions of a keyboard with individual keys by such a touch-sensitive key pad by assigning certain functions to definite regions of the key pad.

In the above-cited WO 92/04724, DE 199 08 406 A1, DE 100 13 444 A1 and U.S. Pat. No. 5,353,016, the key pad is transparent and consists, for example, of a transparent plate.

Likewise, all these known remote controls have yet another housing, in which electronic circuits, a power supply, usually in the form of a battery, a transmitting diode, and possibly yet other components are accommodated. The housings are usually injected molded from plastic at present.

The production of the housing is material-, tooling-, and assembly-intensive and requires a high energy expenditure for the plastic molding. Since, in practice, remote controls often have only a limited lifetime, the disposal is also problematical and expensive, especially on account of the high plastic percentage of the housing and the key pads. Furthermore, for very many remote controls, the operation is very complicated on account of an enormous number of keys and many people do not master it.

SUMMARY OF THE INVENTION

The problem of the invention is to improve the remote control of the kind mentioned at the outset so that it can be produced with less material, tooling and assembly expense, and its disposal is also easier. Furthermore, it should also have an interesting and attractive design.

This problem is solved by the features indicated in patent claim 1. Advantageous embodiments and further modifications of the invention will be found in the subclaims.

BRIEF DESCRIPTION OF THE FIGURES

The invention will be explained in greater detail hereafter by means of a sample embodiment in connection with the drawing. There is shown.

DETAILED DESCRIPTION OF PREFERRED EMBODIMENTS

Figure 1:
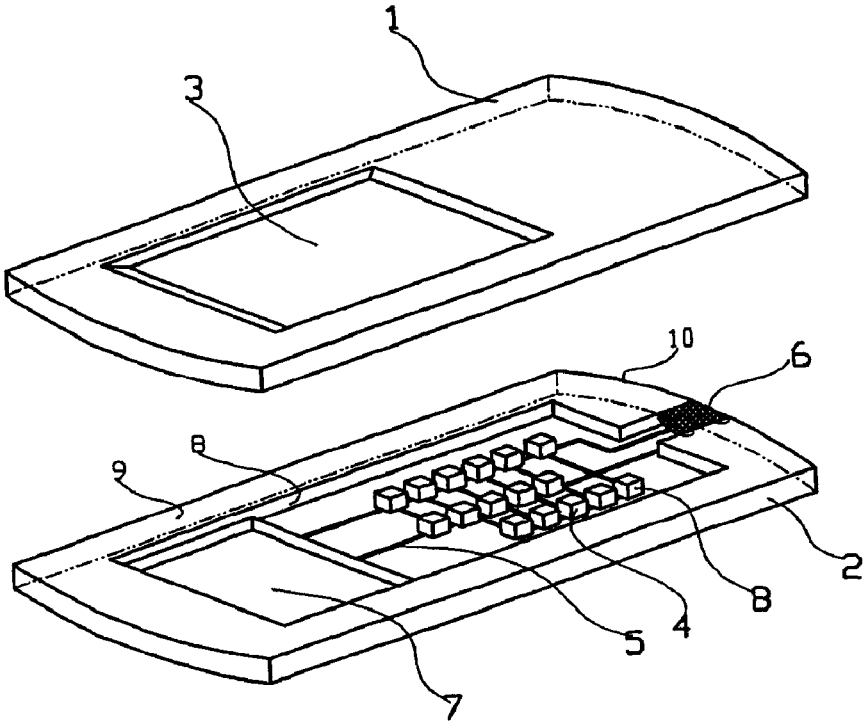
FIG. 1, a schematic exploded representation of the remote control of the invention.

The invention thus creates a housing-less key pad from two plates, preferably at least one of which is a glass plate or transparent plate similar to glass, such as an acrylic plate, which at the same time takes on the function of a conductor track board and the function of a housing, while also a touch-sensitive key pad and especially preferably a touch pad is integrated into one or both plates. Conductor tracks of the electronic circuit are printed on one or both plates, which is preferably done with electrically conductive, transparent lacquer, and other components of the electronic circuit, such as resistors, capacitors, or semiconductor components, can also be printed on one or both plates. Additional components, such as a microprocessor, or the transmitting unit, such as an infrared transmitting diode and possibly also an infrared receiving diode, are fastened to one of the plates, for example, they are glued on and electrically connected to the conductor tracks and the other printed components.

The touch-sensitive key plate can likewise be integrated in one or both plates, and preferably a capacitively working touch pad is used, which requires a cover layer any way, being realized by a boundary surface of one of the plates.

According to one embodiment of the invention, the power supply is also placed on one of the plates, whether in the form of a printed storage capacitor, which is energized by solar cells that are printed onto the bottom side of one of the plates, away from the touch-sensitive key pad, or by a storage battery printed on one of the plates and likewise charged by the aforesaid solar cells.

According to the invention, a position sensor is provided, which along with the other electronic components is placed on one of the plates and has the function of an on/off switch. The position sensor recognizes either statically or dynamically the particular position of the remote control and switches the electronics on or off, depending on whether the remote control is positioned with the key pad facing up (switched on) or facing down (switched off). A statically working "switch" can be, for example, a mercury switch or a switch with a gravity-operated switching element. Also conceivable are optical switches, which are realized by light-sensitive components and which generate an electric current when light is received, which is used to turn on the electronics. In the active operating position, when the touch-sensitive key pad is normally facing up, such a light sensor receives sufficient light to respond. On the other hand, if the remote control is set down with the light-sensitive key pad facing down, such a light sensor is also darkened if the remote control is lying on a table, for example, and the remote control is switched off. Sensors are also conceivable that work magnetically and respond to a movement in the earth's magnetic field. In general, every kind of position sensor is possible, and the above mentioned sensors or switches are cited merely as examples.

The transmitting diode customarily used can be integrated into the plates so that they have the shape of an optical lens in the region of the sensor diode.

The electronic circuit can be made for the most part invisible to the outside in that one of the plates has a mirror layer, in addition to the use of the aforementioned transparent, electrically conductive lacquer.

In the final assembly of the remote control, only two plates studded with corresponding components need to be joined together, which is preferably done by gluing.

Thus, once the plate serving as the conductor track board has been mounted with its components, the final assembly is substantially simplified. The material expense is also substantially simplified as compared to the traditional plastic housings. Environmentally-friendly disposal of the plates is also no problem. Since the bulk of the power supply comes from solar cells, neither do any batteries harmful to the environment have to be disposed of, while in the case of printed storage batteries only very thin layers and thus slight amounts of environmentally harmful substances are present.

In the case of glass plates, disposal is usually done by melting the glass, while the electrical and electronic components can then be burned without problem. No material sorting is necessary, as is the case with out "electronic scrap". Finally, one also achieves an interesting and attractive design thanks to the plates and especially glass plates.

The remote control is composed of two plates 1 and 2, which are preferably made of glass, being joined to each other in the fully assembled state, for example, by gluing or welding. Plate 1 contains a touch-sensitive key pad 3, which in particular is a so-called touch pad, wherein the cover layer present in familiar touch pads is formed by a portion of the plate 1 itself. The electronic components of the touch pad 3 (see reference number 11 in FIG. 2) are arranged on the underside of the plate 1. In the touch pads which are usually of capacitive operation, these components are printed on the underside of the plate 1, which is done for example in the silk screen printing technique. The term underside refers to the side of the plate 1 facing the second plate 2.

On the second plate 2 are arranged electrical and electronic components 4, which are connected together by conductor tracks 5 likewise printed on the second plate 2. Preferably, the conductor tracks are of electrically conductive transparent lacquer. Thus, the second plate serves as a conductor track board, which carries the conductor tracks 5 and the electronic components 4. The electronic components 4 are shown here only schematically as blocks. They can be both printed passive components, such as resistors or capacitors, or also other components such as microchips, processors, transistors or the like. Depending on the height of these components 5, a recess 8 is provided in the top side of the second plate 2, corresponding at least to the height of the components 4, so that the two plates 1 and 2 can be joined together at their edges 9.

Naturally, it is also possible to provide the recess 8 in the upper plate 1, so that the lower plate 2 has an overall level surface.

Moreover, a transmitting device 6 is inserted in the plate 2 or also in both plates 1 and 2, being for example an infrared transmitting diode, which is used in the conventional infrared remote controls. This is also connected to corresponding conductor tracks 5. For this, the plate 1 and/or 2 has a corresponding recess. If desired, the end face of one or both plates 1 and/or 2 can also have the shape of an optical lens 12, in order to focus the light beam of the transmitting device. This optical lens 12 is thus integrated into one or both of the plates 1 and/or 2.

Moreover, an electrical energy store 2 is arranged on one of the plates, here, the plate 2, being for example printed as a storage capacitor 7, or also as a rechargeable storage battery. The power supply comes from solar cells 9, which are arranged on the outside of the lower plate 2 and are responsible for the basic power supply. The energy store 7 thus serves essentially only as a buffer store. Even in a remote control for home electronics, such as a television set, there is still sufficient light energy present even when the television set is working in darkened rooms for the solar cells 9 to provide energy to the electronics and the transmitting device.

According to the invention, a position sensor 8 is provided for turning the remote control on and off, being one of the depicted electrical or electronic components and switching the remote control on and off according to its position. In the most simple case, this can be an electrical switch, having a switching element that works by gravity. In the normal working position, when the touch pad 3 is pointing upward, this switch is closed, so that the electronics are switched on. For the switch off, it is only necessary to turn the remote control over, so that the touch pad points downward. As mentioned at the outset, the position sensor can also have a different configuration, for example, in the form of a mercury switch or an optical sensor.

So that the electrical and electronic components 4 are not visible from the outside, despite the use of plates, the touch pad 3 can be provided with a nontransparent layer, which is preferably applied to the side of the touch pad pointing inward, and the components are then arranged underneath this layer. Thanks to the use of the electrically conductive, transparent lacquer, the conductor tracks can be made for the most part invisible, so that even if they lie outside the region covered by the touch pad they cannot be seen.

It is also possible to provide one side of the two plates with a mirror layer, for example, the underside of plate 2 with the mirror layer 13 or the top side or the underside of plate 1 around the touch pad 3, so that in the active operating position the components cannot be seen. Of course, the mirror layer can also be applied to an inside pointing toward the other plate.

Finally, it should be mentioned that the touch pad 3 can also be installed as a separate component in a recess of the plate 1.

On the whole, one achieves a housing-less and keyless remote control, in which the functions of conductor track board and housing are realized by the plates 1 and 2.

Figure 2:
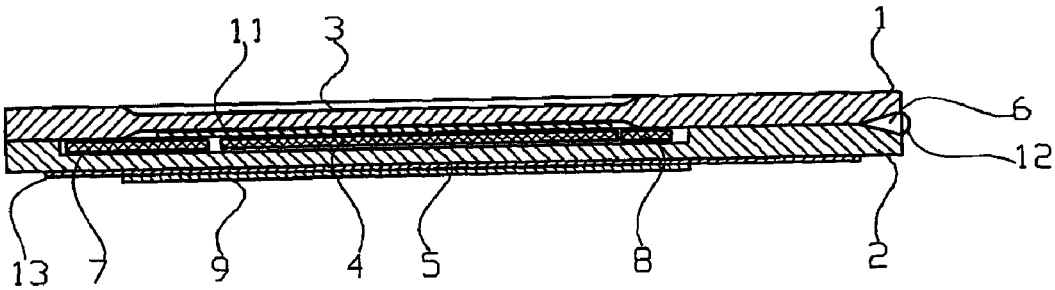
FIG. 2, a schematic longitudinal section of the remote control of the invention in the assembled state.

As shown in the FIGS. 1 and 2, the touch pad 3 is arranged somewhat recessed in relation to the surface of the plate 1. Of course, it can also be configured so that—like the rest of the components 4—it is arranged between the two plates 1 and 2, so that the outwardly pointing surface of the plate 1 is perfectly level. With the use of the touch pad 3, one no longer needs any separate keys. By suitable programming of the electronic components, one can coordinate certain functions with certain regions of the touch pad, and these regions can also be marked by appropriate imprintings.

The invention claimed is:

1. Remote control comprising:
electronic components;
a touch-sensitive key pad;
an energy store;
a transmitter; and
two plates joined together, on which the electronic components, the key pad, the energy store and the transmitting device are arranged;
wherein one of the electronic components is a position sensor, which has the function of an on/off switch, depending on its position or orientation; and
further comprising conductor tracks interconnecting the electronic components and wherein the electronic components and conductor tracks are printed on one of the plates.

2. The remote control of claim 1 wherein the position sensor turns the remote control on and off depending on its position or orientation.

3. The remote control of claim 1 wherein the position sensor turns a remotely controlled device on and off depending on its position or orientation.

4. Remote control comprising:
electronic components;
a touch-sensitive key Pad;
an energy store;
a transmitter; and
two plates joined together, on which the electronic components, the key pad, the energy store and the transmitting device are arranged;
wherein one of the electronic components is a position sensor, which has the function of an on/off switch, depending on its position or orientation; and
wherein solar cells are printed on one of the plates.

5. Remote control comprising:
electronic components;
a touch-sensitive key pad;
an energy store;
a transmitter; and
two plates joined together, on which the electronic components, the key pad, the energy store and the transmitting device are arranged;
wherein one of the electronic components is a position sensor, which has the function of an on/off switch, depending on its position or orientation; and
wherein one side of one of the plates is provided with a mirror layer.

6. Remote control comprising:
electronic components;
a touch-sensitive key pad;
an energy store;
a transmitter; and
two plates joined together, on which the electronic components, the key pad, the energy store and the transmitting device are arranged;
wherein one of the electronic components is a position sensor, which has the function of an on/off switch, depending on its position or orientation; and
wherein the transmitter is a light-emitting diode and one region of one end face of at least one of the plates lying opposite the light-emitting diode is configured in the form of an optical lens.

7. The remote control according to claim 6 wherein the light-emitting diode is an infrared diode.

8. The remote control according to claim 1 wherein the touch-sensitive key pad is a touch pad.

9. Remote control comprising:
electronic components;
a touch-sensitive key pad;
an energy store;
a transmitter; and
two plates joined together, on which the electronic components, the key pad, the energy store and the transmitting device are arranged;
wherein one of the electronic components is a position sensor, which has the function of an on/off switch, depending on its position or orientation;
wherein the touch-sensitive key pad is a touch pad; and
wherein the touch pad is integrated into one of the plates.

10. The remote control according to claim 8 wherein the touch pad is a separate component that is installed in a recess in one of the plates.

11. The remote control according to claim 8 wherein the electronic components are arranged so that they are covered by the touch pad.

12. Remote control comprising:
electronic components;
a touch-sensitive key pad;
an energy store;
a transmitter; and
two plates joined together, on which the electronic components, the key pad, the energy store and the transmitting device are arranged;
wherein one of the electronic components is a position sensor, which has the function of an on/off switch, depending on its position or orientation; and
wherein at least one of the plates is a glass plate.

13. The remote control according to claim 1 wherein the touch-sensitive key pad is a touch pad and wherein the touch pad is integrated into one of the plates or is a separate component that is installed in a recess in one of the plates.

14. Remote control comprising:
electronic components comprising resistors, capacitors, microchips, processors, and/or transistors;
a touch-sensitive key pad;
an energy store;
a transmitter;
two plates joined together, on which the electronic components, the key pad, the energy store and the transmitting device are arranged, wherein at least one of the plates is a glass plate;
conductor tracks interconnecting the electronic components wherein the conductor tracks are printed on one of the plates;
wherein the transmitter is a light-emitting diode and one region of one end face of at least one of the plates lying opposite the light-emitting diode is configured in the form of an optical lens;
wherein the touch-sensitive key pad is a touch pad;

wherein the electronic components are arranged so that they are covered by the touch pad; and wherein one of the electronic components is a position sensor, which turns the remote control on and off depending on its position or orientation.

15. The remote control of claim 14 comprising:

the electronic components comprising resistors, capacitors, microchips, processors, and/or transistors;

the touch-sensitive key pad;

the energy store;

the transmitter;

the two plates joined together, on which the electronic components, the key pad, the energy store and the transmitting device are arranged, wherein at least one of the plates is a glass plate;

the conductor tracks interconnecting the electronic components wherein the conductor tracks are printed on one of the plates;

solar cells printed on one of the plates; and a mirror layer on one side of one of the plates;

wherein the transmitter is a light-emitting diode and one region of one end face of at least one of the plates lying opposite the light-emitting diode is configured in the form of an optical lens;

wherein the touch-sensitive key pad is a touch pad;

wherein the electronic components are arranged so that they are covered by the touch pad; and wherein one of the electronic components is a position sensor, which turns the remote control on and off depending on its position or orientation.

16. The remote control according to claim 15 wherein the touch pad is integrated into one of the plates or the touch pad is a separate component that is installed in a recess in one of the plates.

17. The remote control of claim 4 wherein the position sensor turns the remote control on and off depending on its position or orientation.

18. The remote control of claim 4 wherein the position sensor turns a remotely controlled device on and off depending on its position or orientation.

19. The remote control of claim 5 wherein the position sensor turns the remote control on and off depending on its position or orientation.

20. The remote control of claim 5 wherein the position sensor turns a remotely controlled device on and off depending on its position or orientation.

21. The remote control of claim 6 wherein the position sensor turns the remote control on and off depending on its position or orientation.

22. The remote control of claim 6 wherein the position sensor turns a remotely controlled device on and off depending on its position or orientation.

23. The remote control of claim 9 wherein the position sensor turns the remote control on and off depending on its position or orientation.

24. The remote control of claim 9 wherein the position sensor turns a remotely controlled device on and off depending on its position or orientation.

25. The remote control of claim 12 wherein the position sensor turns the remote control on and off depending on its position or orientation.

26. The remote control of claim 12 wherein the position sensor turns a remotely controlled device on and off depending on its position or orientation.

* * * * *